US007827998B2

(12) United States Patent
Rebours

(10) Patent No.: US 7,827,998 B2
(45) **Date of Patent: *Nov. 9, 2010**

(54) MASCARA BRUSH

(75) Inventor: Christophe Rebours, Suresnes (FR)

(73) Assignee: AmorePacific Corporation, Seoul (KR)

( * ) Notice: Subject to any disclaimer, the term of this patent is extended or adjusted under 35 U.S.C. 154(b) by 218 days.

This patent is subject to a terminal disclaimer.

(21) Appl. No.: 11/815,593

(22) PCT Filed: Mar. 2, 2006

(86) PCT No.: PCT/KR2006/000714

§ 371 (c)(1),
(2), (4) Date: Aug. 6, 2007

(87) PCT Pub. No.: WO2006/095973

PCT Pub. Date: Sep. 14, 2006

(65) Prior Publication Data

US 2008/0314403 A1 Dec. 25, 2008

(30) Foreign Application Priority Data

Mar. 8, 2005 (KR) ..... 20-2005-0006260 U

(51) Int. Cl.
*A45D 40/26* (2006.01)
*A46B 11/00* (2006.01)

(52) U.S. Cl. ..... 132/218; 401/129

(58) Field of Classification Search ..... 132/218, 132/317, 319; 401/126, 129; 15/187, 188, 15/207.2

See application file for complete search history.

(56) References Cited

U.S. PATENT DOCUMENTS

| | | | | |
|---|---|---|---|---|
| 4,527,575 | A * | 7/1985 | Vasas | 132/218 |
| D445,573 | S * | 7/2001 | Naghibi | D4/136 |
| 6,591,842 | B2 * | 7/2003 | Gueret | 132/218 |
| 6,691,716 | B2 * | 2/2004 | Neuner et al. | 132/218 |

* cited by examiner

*Primary Examiner*—Robyn Doan
(74) *Attorney, Agent, or Firm*—John K. Park; Park Law Firm

(57) ABSTRACT

Provided is a disk-type mascara brush, used to makeup eyelash with mascara solution applied thereto, whose brush portion is formed whole at the end of a wand and in such a shape that pluralities of triangle-like elliptic disks are piled consecutively with an alternated arrangement with the angle of 120 degree. In a disk-type mascara brush where a brush portion 1 is provided at one end of a wand 2, a mascara cap 3 is provided at the other end of a wand 2 and the brush portion 1 is formed at the end of the wand 2 as if disks are piled; the mascara brush includes a brush portion 10 which is formed whole at the end of the wand and in such a shape that plurality of triangle-like elliptic disks are piled consecutively with an alternated arrangement with the angle of 120 degree. Thereby, a tooth-protruded portion 14, where the plate-tooth 12 is protruded, and a tooth-indented portion 16, where the plate-tooth 12 is indented, are formed at the outer circumstance of the brush portion 10 respectively; and a tooth-spaced portion 18 is formed between the tooth-protruded portion 14 and the tooth-indented portion 16.

5 Claims, 6 Drawing Sheets

[Fig. 1]
[Prior Art]
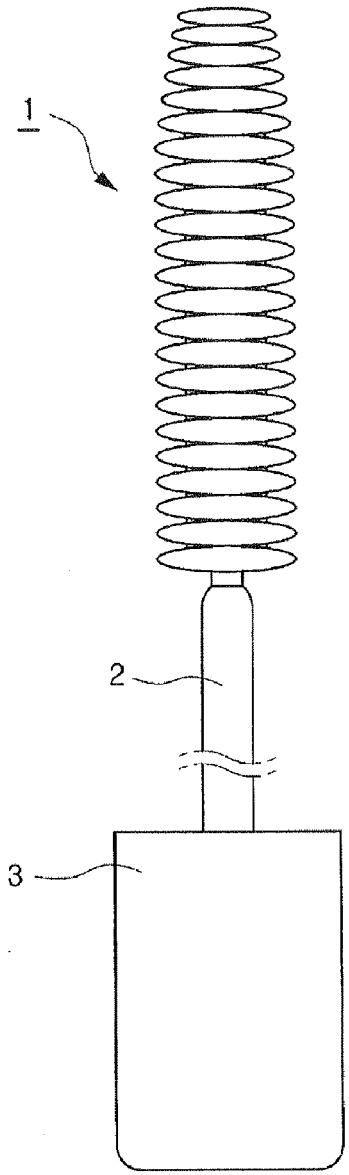

[Fig. 2]
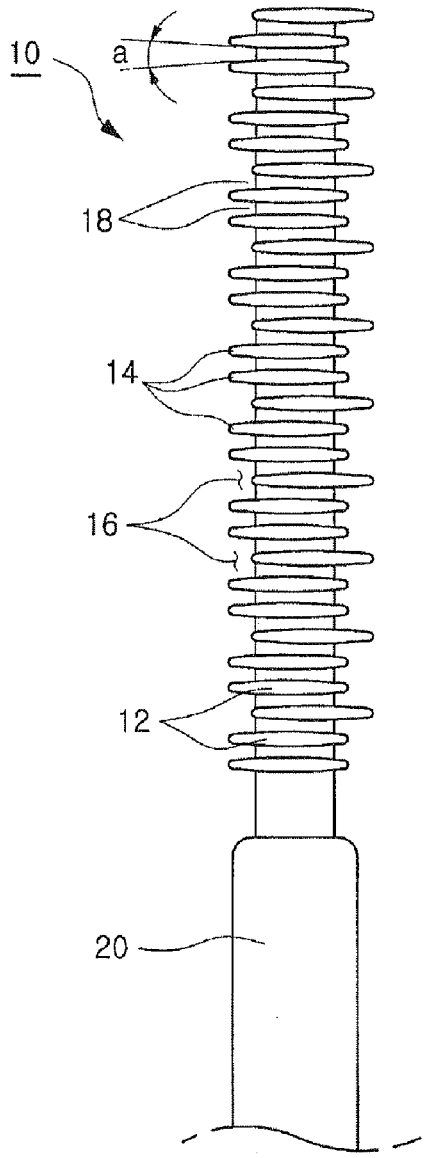

[Fig. 3]
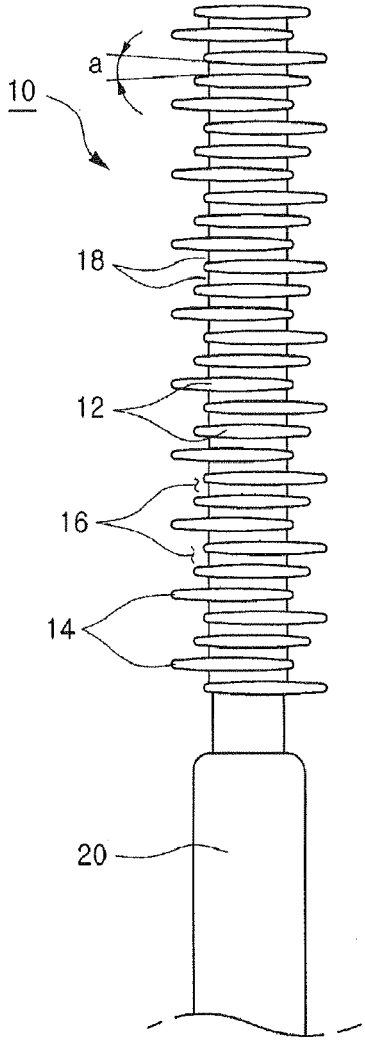
[Fig. 4]
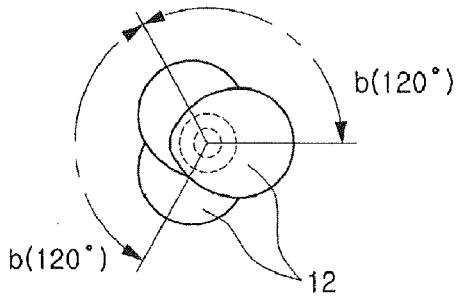

[Fig. 5]
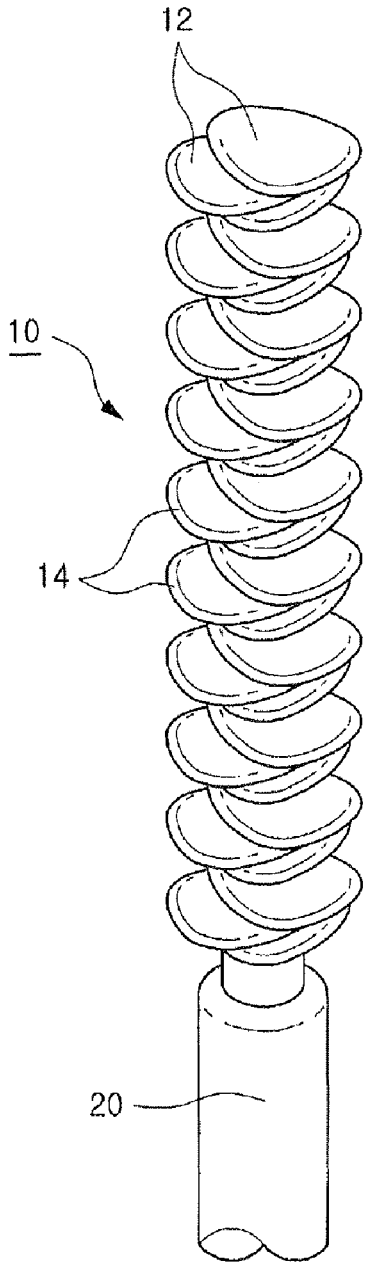

[Fig. 6]
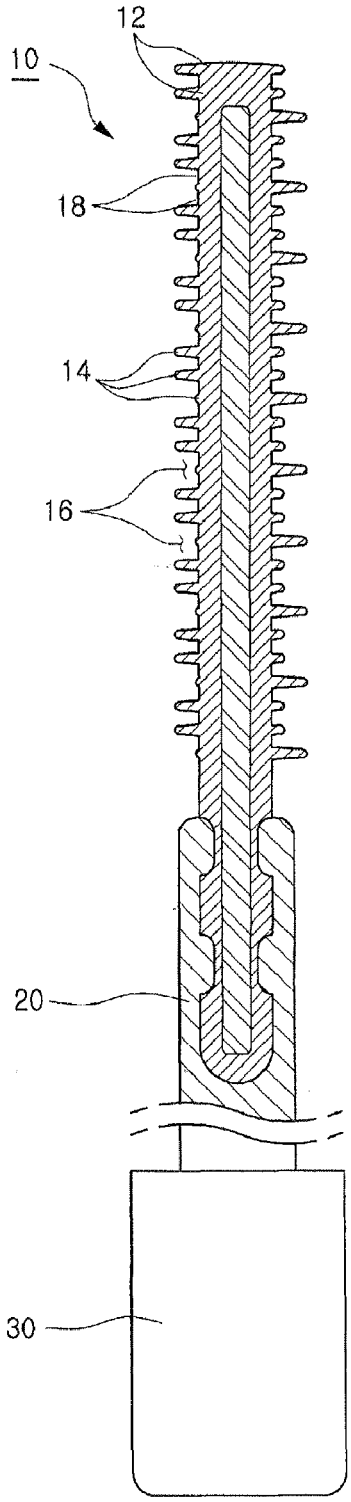

[Fig. 7]
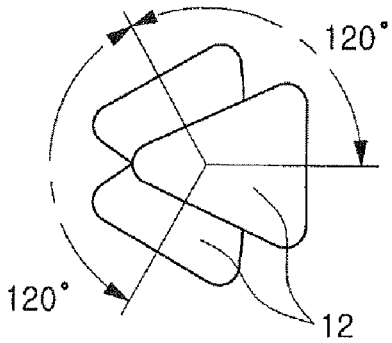
[Fig. 8]
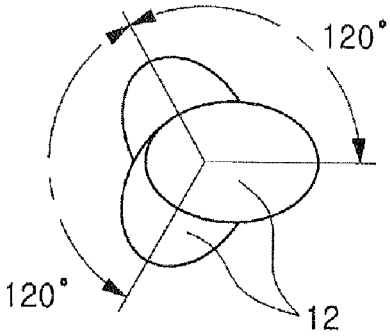

MASCARA BRUSH

TECHNICAL FIELD

The present invention relates to a mascara brush which is used for performing makeup of eyelash with mascara solution applied thereto, and more particularly, relates to a disk-type mascara whose brush portion is formed whole at the end of a wand and in such a shape that plurality of triangle-like elliptic disks are piled consecutively with an alternated arrangement with the angle of 120 degree.

BACKGROUND ART

Generally, mascara is comprised of a case for containing mascara solution with a constant viscosity and a tone of color, a mascara brush for applying the mascara solution contained in the case to eyelash and a cap assembled to the mascara brush.

There are two kinds of conventional mascara brushes; a bristle-brush twisted from two wires with plastic bristles and a disk-type mascara brush whose brush portion is formed at the end of a wand as if pluralities of disks are piled consecutively.

Because the conventional bristle-brush is made by plastic bristles twisted with wires, its process is so complex that productivity is low and there are difficulties in maintaining constant quality of the brush. Although the disk-type brush that is made whole by plastic or rubber, as disclosed in Japan patent application No. 1988-85113, U.S. Pat. No. 6,591,842 and Korean Laid-upon patent No. 2002-0095157, is productive and easy to maintain quality, it is hardly capable to comb eyelash up than the bristle-brush, so that it does not widely spread to the Eastern people whose eyelash is short and thin.

The disk-type mascara brush does not stimulate eyelash much so that feeling in use is superior to the bristle-brush because it is mainly made of a silicon rubber. However, because center of all the plate-tooth are identical to that of the wand and the size of all the plate-tooth is identical, eyelash becomes combed up while the plate-tooth is hardly snuggled into eyelash when combing eyelash up with the mascara brush to which mascara solution is applied, so that not only eyelash cannot be combed well or curled roundly to the tip but also there happens a problem that eyelash clings together.

DISCLOSURE OF INVENTION

Technical Problem

The present invention is designed to solve at least one of those problems. An object of the present invention is to provide a mascara brush capable of minimizing stimulation to eyelash as well as snuggling the plate-tooth of a mascara brush into eyelash easily, so that not only curling of eyelash can be performed easily, eyelash can be arranged in order and a natural eyelash makeup is possible but also productivity is maximized and constant quality can be maintained by forming it whole.

Technical Solution

According to an aspect of the present invention, there is provided of a mascara brush where the brush portion is formed at the end of the wand as if disks are piled as well as the conventional disk-type mascara brush, the mascara brush is characterized in that the brush portion of the mascara brush is formed whole and in such a shape that triangle-like elliptic disks are piled consecutively with an alternated arrangement with the angle of 120 degree.

Advantageous Effects

According to the present invention, productivity can be maximized because the brush portion is produced simply by forming it whole, cost can be reduced and consumer's credit can be achieved because constant quality can be maintained, stimulation to eyelash can be minimized because it is made of soft and elastic material such as silicon rubber. Further mascara solution can be applied to eyelash so plentiful that eyelash can be shown exuberantly because the brush portion is formed in such a shape that triangle-like elliptic disks are piled consecutively with an alternated arrangement with the angle of 120 degree so that tooth-indented portion is formed between tooth-protruded portions. In addition, curling of eyelash can be done well, no cling of eyelash exists and natural eyelash makeup can be done because combing is performed as tooth snuggles into eyelash well.

BRIEF DESCRIPTION OF THE DRAWINGS

FIG. 1 shows a front view of a conventional mascara brush;

FIG. 2 shows a front view of the mascara brush according to an embodiment of the present invention;

FIG. 3 shows a side view of the mascara brush according to an embodiment of the present invention;

FIG. 4 shows a plain view of the mascara brush according to an embodiment of the present invention;

FIG. 5 shows a perspective view of the mascara brush according to an embodiment of the present invention;

FIG. 6 shows a vertical sectional view of the mascara brush according to an embodiment of the present invention;

FIG. 7 shows a plain view of the plate-tooth according to another embodiment of the present invention; and FIG. 8 shows a plain view of the plate-tooth according to still another embodiment of the present invention.

DESCRIPTION OF THE PARTS

10. brush portion
12. plate-tooth
14. tooth-protruded portion
16. tooth-indented portion
18. tooth-spaced portion
20. wand
30. mascara cap.

MODE FOR THE INVENTION

The mascara brush of the present invention will now be described in detail taken into drawings accompanied.

Because the accompanied drawings are only an example to show the technical idea of the present invention, and thus it should be understood that the accompanied drawings do not limit the technical idea of the present invention.

FIG. 2 shows a front view of the mascara brush according to an embodiment of the present invention, FIG. 3 shows a side view of the mascara brush according to an embodiment of the present invention, FIG. 4 shows a plain view of the mascara brush according to an embodiment of the present invention, FIG. 5 shows a perspective view of the mascara brush according to an embodiment of the present invention, FIG. 6 shows a vertical sectional view of the mascara brush according to an embodiment of the present invention, FIG. 7 shows a plain view of the plate-tooth according to another embodiment of the present invention and FIG. 8 shows a plain view of the plate-tooth according to still another embodiment of the present invention.

As it is found, a disk-type mascara brush according to the present invention has a brush portion 1 provided at one end of a wand 2, a mascara cap 3 provided at the other end of a wand 2 and the brush portion 1 formed whole at the end of the wand 2. In particular, the brush portion 10 is formed whole and in such a shape that triangle-like elliptic disks are piled consecutively with an alternated arrangement with the angle of 120 degree (b).

The arranging angle of 120 degree (b) of the plate-tooth 12 is an angle to ensure that the plate-tooth 12 can comb eyelash easily. It is known by experiments that similar effect can be achieved with an arranging angle of 90 degree of the plate-tooth 12. Thus it is preferable that the arranging angle of the plate-tooth 12 is 90 degree or 120 degree.

Although the shape of each plate of the plate-tooth 12 which constitutes the brush portion 10 is shown triangle-like elliptic, as shown in FIG. 4, it is only an example embodiment of the present invention. Thus, of course, being triangular as shown in FIG. 7 or being elliptic as shown in FIG. 8 can be included as long as it implements the technical idea of the present invention. Further, the reason to explain the shape of each plate of the plate-tooth 12 is not for being separated of each plate but for explaining the shape of the brush portion 10 of the present invention. It should be noticed that the plate-tooth 12 is not separated independently from each other but formed whole as shown in FIG. 6.

In addition, material of the brush portion 10 can be silicon rubber, rubber, nylon, polyethylene, polypropylene, etc, and more preferably, it is made of silicon rubber.

The portion where the plate-tooth 12 is protruded at the outer circumstance of the brush portion 10 makes a tooth-protruded portion 14 and the portion where the plate-tooth 12 is indented make a tooth-indented portion 16, and tooth-spaced portion 18 is formed between the tooth-protruded portion 14 and the tooth-indented portion 16.

The operation of the mascara brush according to the present invention will now be described.

As described above, the mascara brush according to the present invention has the tooth-protruded portion 14 and the tooth-indented portion 16 at the outer circumstance thereof. When the mascara brush according to the present invention is taken out after putting it in a mascara container in order to make up eyelash, much mascara solution can be applied in the tooth-indented portion 16 between the tooth-protruded portions 14, thus mascara solution can be applied to the eyelash easily and curling of eyelash can be done easily by using the tooth-protruded portion 14. Because the tooth-protruded portion 14 can snuggles into eyelash, even the Eastern people, whose eyelash is short and thin, can make eyelash looked exuberantly and curled easily.

In addition, because the tooth-spaced portion 18 with slant between the plate-tooth 12, eyelash can be combed up while being inserted in the tooth-spaced portion 18 when combing to makeup eyelash, thus effect to curl eyelash is very excellent. It is suitable that the angle (a) of the tooth-spaced portion 18 is ranged between 5 degree and 30 degree, more preferably, between 7 degree and 30 degree. If the angle (a) of the tooth-spaced portion 18 exceeds 30 degree, effect to curl is decreased because eyelash can not be inserted into the tooth-indented portion 18 when combing eyelash.

The invention claimed is:

1. A disk-type mascara brush where a brush portion is provided at one end of a wand, a mascara cap is provided at the other end of a wand and the brush portion is formed at the end of the wand as if disks are piled, the mascara brush is characterized in that;

a brush portion is formed whole and in such a shape that triangle-like convex elliptic disks are piled parallel to each other and configured for adjacent disks to rotate 120 degrees consecutively around a vertical axis of the brush portion wherein a tooth-protruded portion is outwardly protruded from the tooth brush portion, and a tooth-indented portion is inwardly indented toward the tooth brush portion, and a tooth-spaced portion is formed between the tooth protruded portion 14 and the tooth-indented portion; wherein the triangle-like elliptic disks are tapered toward outer perimeter thereof; wherein adjacent tapered disk-type plate teeth are close enough so that much mascara solution can be applied to the tooth-protruded portion and the tooth indented portion; wherein slant angle between surfaces of two adjacent triangle-like elliptic disks is ranged between 5 degree and 30 degree so that eyelashes are inserted into the tooth-spaced portion to be curled.

2. The mascara brush of claim 1, wherein the shape of the plate-tooth 12 is triangle-like elliptic, elliptic or triangular.

3. The mascara brush of claim 1, wherein the arranging angle of the plate-tooth 12 is 90 degree or 120 degree.

4. The mascara brush of claim 1, wherein the brush portion 10 is made of silicon rubber, nylon, polyethylene or polypropylene.

5. The mascara brush of claim 1, wherein the slant angle between surfaces of two adjacent triangle-like elliptic disks is ranged between 7 degree and 15 degree so that eyelashes are inserted into the tooth-spaced portion 17 to be curled.

* * * * *